US006767087B2

(12) United States Patent
Yamada et al.

(10) Patent No.: US 6,767,087 B2
(45) Date of Patent: Jul. 27, 2004

(54) INKJET HEAD PROVIDED WITH DEFLECTING ELECTRODES FOR DEFLECTING EJECTED INK DROPLETS

(75) Inventors: Takahiro Yamada, Hitachinaka (JP); Kunio Satou, Hitachinaka (JP); Shinya Kobayashi, Hitachinaka (JP); Hitoshi Kida, Hitachinaka (JP)

(73) Assignee: Hitachi Printing Solutions, Ltd., Kanagawa (JP)

( * ) Notice: Subject to any disclaimer, the term of this patent is extended or adjusted under 35 U.S.C. 154(b) by 0 days.

(21) Appl. No.: 10/329,506

(22) Filed: Dec. 27, 2002

(65) Prior Publication Data

US 2003/0122903 A1 Jul. 3, 2003

(30) Foreign Application Priority Data

Dec. 28, 2001 (JP) ..... P2001-398766

(51) Int. Cl.[7] ..... B41J 2/09
(52) U.S. Cl. ..... 347/77
(58) Field of Search ..... 347/77, 73, 74, 347/75, 76, 82, 90

(56) References Cited

U.S. PATENT DOCUMENTS 4,368,475 A * 1/1983 Donahue ..... 347/77
4,384,295 A * 5/1983 Lewis et al. ..... 347/77
4,667,207 A * 5/1987 Sutera et al. ..... 347/90

FOREIGN PATENT DOCUMENTS

JP 2001-47622 2/2001

* cited by examiner

*Primary Examiner*—K. Feggins
(74) *Attorney, Agent, or Firm*—Whitman, Curtis & Christofferson, P.C.

(57) ABSTRACT

A plurality of nozzle rows are formed in a nozzle plate, and nozzle electrodes for generating a deflecting field are provided for every two nozzle rows. Each electrode is attached to the nozzle plate so as to locate between the corresponding adjacent two nozzles. Ink reception absorption bodies are embedded in the bottom surface of the electrodes. Refresh ink droplets deflected by the deflecting field travels along U-turn paths and impinge on the ink reception absorption bodies.

17 Claims, 5 Drawing Sheets

INKJET HEAD PROVIDED WITH DEFLECTING ELECTRODES FOR DEFLECTING EJECTED INK DROPLETS

BACKGROUND OF THE INVENTION

1. Field of the Invention

The present invention relates to an inkjet printer, and more particularly a high-speed inkjet printer capable of reliably forming high-quality images.

2. Related Art

Line-scan inkjet printers are a type of high-speed inkjet printer capable of printing on a continuous recording sheet at high speed, and include an elongated inkjet recording head formed with rows of nozzles for ejecting ink droplets. The head is arranged in confrontation with the surface of the recording sheet across the entire width of the recording sheet. The head selectively ejects ink droplets from the nozzles based on a recording signal and impinges the droplets on desired positions across the width of the recording sheet. At the same time, the recording sheet is transported rapidly in its lengthwise direction, which serves as a main scanning operation, so that images can be recorded at any place on the recording sheet.

Various types of line-scan inkjet printers have been proposed, such as printers that use a continuous inkjet type recording head and printers that use a drop-on-demand type recording head. Although drop-on-demand type line-scan inkjet printers have a slower printing speed than do continuous inkjet type line-scan inkjet printers, they have an extremely simple ink system and so are well suited for a general-purpose high-speed printer.

A recording head of a drop-on-demand type line-scan inkjet printer disclosed in Japanese Patent-Application Publication (Kokai) No. 2001-47622 includes nozzle elements that eject ink droplets through corresponding nozzles when a driving voltage is applied to corresponding piezoelectric elements or heat-generating elements. A charge/deflect electrode is provided along a nozzle row for deflecting ejected ink droplets so that a plurality of ink droplets ejected from adjacent nozzles impinge on the same pixel position. With this configuration, a complete image can be obtained without missing any information even if one or more of the nozzle elements become defective. Further, uneven color density undesirably appearing on obtained images due to unevenness in characteristics among the nozzle elements can be prevented. Accordingly, highly-reliable drop-on-demand line-scan inkjet recording devices are provided.

There is also proposed to eject refresh ink droplets that do not contribute to forming dots on a recording sheet, in order to prevent ink clinging around nozzles from drying and getting dense since high-viscosity ink clinging around the nozzles prevents proper ink ejection. The ejected refresh ink droplets are deflected and collected by an ink collection member without impinging on the recording medium.

SUMMARY OF THE INVENTION

Here, FIGS. 1(*a*) and 1(*b*) show a configuration of a conceivable deflecting device, wherein ejected refresh ink droplets 142 are deflected by an angled electric field 85 so as to impinge on ink reception absorption bodies 27 embedded in nozzle electrodes 221 after traveled along U-turn paths 93. The nozzle electrodes 221 are disposed for every one of nozzle rows 121, that is, the nozzle electrodes 221 are provided in one-to-one correspondence with the nozzle rows 121. Accordingly, when a recording head has a large number of nozzle rows 121 arranged at a narrow pitch where a gap between adjacent two nozzle rows 121 is small, then electrode windows 22 provided for every nozzle rows 121 cannot have a sufficient width. In this configuration, only an insufficient space is provided between a nozzle row 121 and a nozzle electrode 221 for an adjacent nozzle row 121. Accordingly, the angled electric field 85 can have only a small field element perpendicular to an ink ejection direction and may deflect the refresh ink droplets 142 only by an insufficient amount.

That is, in FIG. 2, where there is a great difference between space $S_B$, which is a distance between a nozzle row 121A and a nozzle electrode 221B for an adjacent nozzle row 121B, and a space $S_A$ which is a distance between the nozzle row 121A and a corresponding nozzle electrode 221A, then, a stronger electric field is generated. On the other hand, when there is only a small difference between the space $S_B$ and the space $S_A$, then there is only generated a weak electric field. This is because an electric field generated by the nozzle electrode 221B weakens the electric field generated by the nozzle electrode 221 A.

Moreover, in the configuration of FIGS. 1(*a*) and 1(*b*), the nozzle electrodes 221 can only have a narrow width, so that ink reception absorption bodies 27 embedded in the bottom surface of the nozzle electrodes 221 only have a narrow width also. Accordingly, if the refresh ink droplet 142 that has been deflected to fly along the U-turn path 93 travels a relatively long distance, then the refresh ink droplet 142 does not impinge on the ink reception absorption body 27, that is, the ink reception absorption body 27 fails to collect the refresh ink droplet 142.

In view of the foregoing, it is an object of the present invention to overcome the above problems and also to provide a deflection device that effectively deflects refresh ink droplets so that the deflected refresh ink droplets are reliably collected by an ink collection member without reaching a recording medium.

In order to achieve the above and other objects, according to the present invention, there is provided an inkjet head including a body formed with a plurality of nozzle rows each including a plurality of nozzles through which ink droplets are ejected, and a plurality of electrodes provided for generating a deflecting field that deflects the ink droplets ejected from the nozzles. One electrode is provided for every two nozzle rows. Each electrode is provided between the corresponding adjacent two nozzle rows.

There is also provided an inkjet head including a body formed with a plurality of nozzle rows each including a plurality of nozzles through which ink droplets are ejected, and a plurality of reception bodies for receiving the ink droplets ejected from the nozzles. One reception body is provided for every two nozzle rows. Each reception body is provided between the corresponding adjacent two nozzle rows and receives the ink droplets ejected from the nozzles of the corresponding two adjacent nozzle rows.

Further, there is provided an inkjet recording device including an inkjet head formed with a plurality of nozzle rows each including a plurality of nozzles through which ink droplets are ejected, and a plurality of electrodes for generating a deflecting field that deflects the ink droplets ejected from the nozzles. One electrode is provided for every two nozzle rows. Each electrode is provided between the corresponding adjacent two nozzle rows.

BRIEF DESCRIPTION OF THE DRAWINGS

In the drawings:

FIG. 1(*b*) is a cross-sectional view of the inkjet head taken along a line Ib—Ib of FIG. 1(*a*);

FIG. 4(*b*) is a cross-sectional view of the inkjet head taken along a line IVb—IVb of FIG. 4(*a*);

PREFERRED EMBODIMENT OF THE PRESENT INVENTION

Next, an inkjet recording device including an inkjet head according to an embodiment of the present invention will be described with reference to the attached drawings.

Figure 1A:
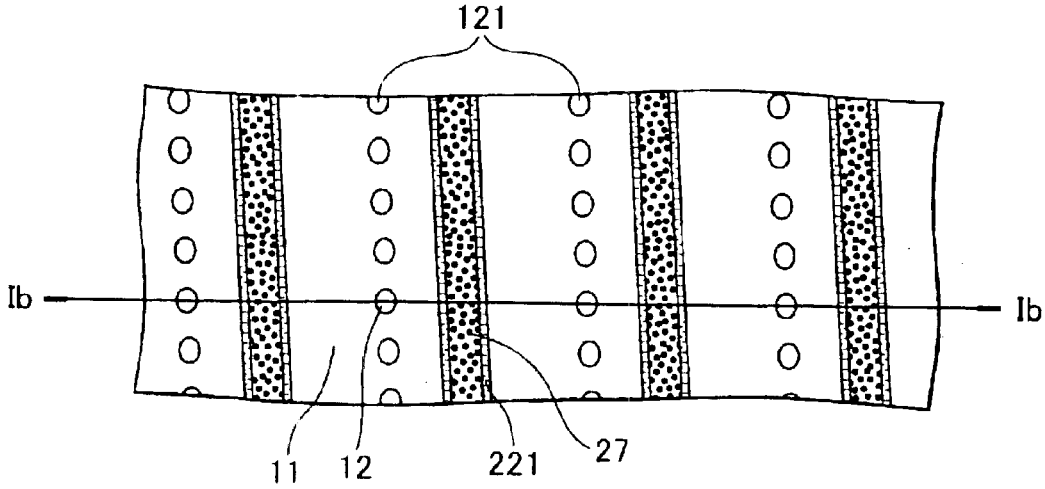
FIG.1(a) RELATED ART
FIG. 1(*a*) is a bottom view of an inkjet head provided with a conceivable deflection device.
Figure 1B:
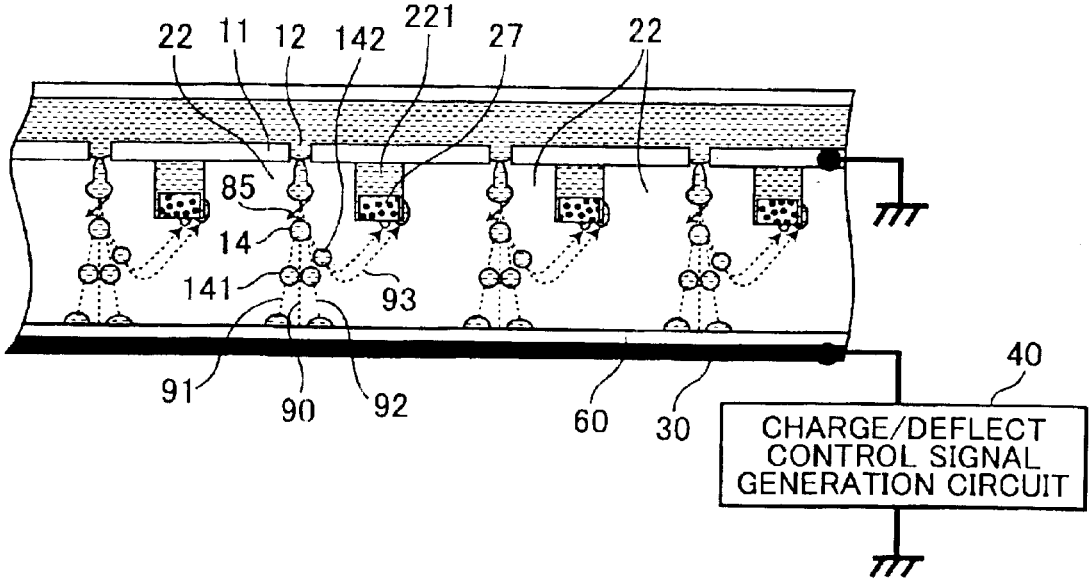
FIG.1(b) RELATED ART
Figure 2:
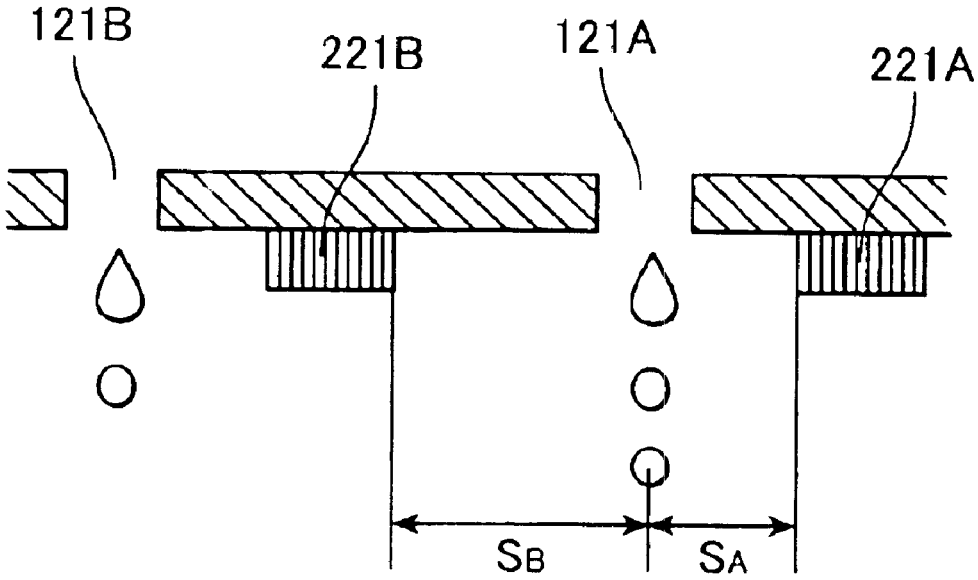
FIG. 2 is schematic view of the conventional inkjet head.
Figure 3:
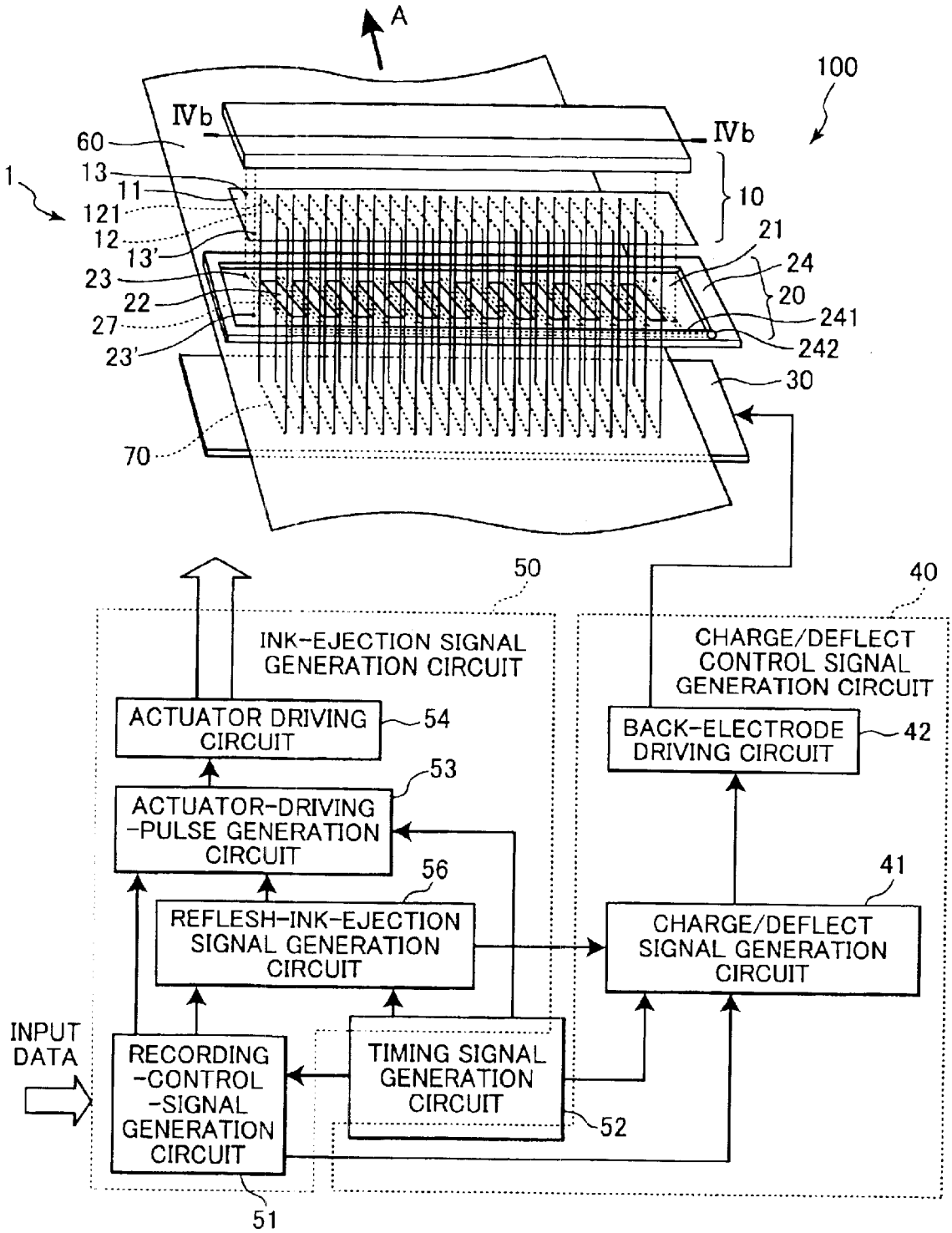
FIG. 3 is a schematic view showing inkjet recording device including a deflecting device according to an embodiment of the present invention.

First, an overall configuration of an inkjet recording device 100 will be described. As shown in FIG. 3, the inkjet recording device 100 includes a recording head 1, a back electrode 30, a charge/deflect control signal generation circuit 40, and an ink-ejection signal generation circuit 50. Although not shown in the drawings, the inkjet recording device 100 further includes a sheet feed mechanism that feeds a recording sheet 60 in a sheet feed direction A.

The recording head 1 includes a head body 10 and a nozzle electrode array/mounter 20. The head body 10 includes an orifice plate 11 formed with m-number of nozzle rows 121, each including n-number of nozzles 12. The nozzle plate 11 is attached intimately to the nozzle electrode array/mounter 20 at a predetermined position and orientation. The nozzle electrode array/mounter 20 is an electrode assembly formed from arrayed charge/deflect electrodes (nozzle electrodes 221 to be described later) formed integrally with each other. The charge/deflect electrodes are in one-to-one correspondence with the nozzle rows 121. The nozzle electrode array/mounter 20 functions as a mounting member that mounts the head body 10, as a nozzle electrode for generating an angled electric field, and as an ink collection member for collecting refresh ink (described later).

The back electrode 30 is disposed in confrontation with the nozzle electrode array/mounter 20 on the opposite side of the recording sheet 60 than the recording head 1. The charge/deflect control signal generation circuit 40 is for generating and supplying charge/deflect signals to the back electrode 30. The ink-ejection signal generation circuit 50 is for generating and supplying ejection signals to the recording head 1.

The charge/deflect control signal generation circuit 40 includes a charge/deflect signal generation circuit 41 and a back-electrode driving circuit 42. The ink-ejection control signal generation device 50 includes a recording-control-signal generation circuit 51, a timing signal generation circuit 52, an actuator-driving-pulse generation circuit 53, an actuator driving circuit 54, and a refresh-ink-ejection-signal generation circuit 56.

The timing signal generation circuit 52 generates a timing signal, and outputs the timing signal to the recording-control-signal generation circuit 51, the actuator-driving-pulse generation circuit 53, the refresh-ink-ejection-signal generation circuit 56, and the charge/deflect signal generation circuit 41.

The recording-control-signal generation circuit 51 generates a recording control signal based on input data and the timing signal, and outputs the same to the actuator-driving-pulse generation circuit 53, the refresh-ink-ejection-signal generation circuit 56, and the charge/deflect signal generation circuit 41. The refresh-ink-ejection-signal generation circuit 56 generates a refresh-ink-ejection actuator driving signal based on the recording control signal, and outputs the same to the actuator-driving-pulse generation circuit 53 and the charge/deflect signal generation circuit 41. The actuator-driving-pulse generation circuit 53 generates a recording pulse signal based on the recording control signal and also generates a refresh-ink-ejection pulse signal based on the refresh ink-ejection-actuator driving signal. The recording pulse signal and the refresh-ink-ejection pulse signal are both ejection signal for driving an actuator (not shown) of the recording head 1. The actuator driving circuit 54 amplifies the recording pulse signal and the refresh-ink ejection pulse signal to suitable level for driving the actuator 70.

The charge/deflect signal generation circuit 41 generates a predetermined charge/deflect signal (voltage) based on the timing signal from the timing signal generation circuit 52 and on the recording control signal from the recording-control-signal generation circuit 51 or on the refresh-ink-ejection actuator driving signal from the refresh-ink-ejection-signal generation circuit 56, and outputs the same to the back-electrode driving circuit 42. The back-electrode driving circuit 42 amplifies the charge/deflect signal to a predetermined voltage, and then outputs the same to the back electrode 30.

Next, the head body 10 will be described in detail. The head body 10 includes n×m number of drop-on-demand type nozzle elements, that have the corresponding nozzles 12 arranged in matrix at a predetermined pitch. Although not shown in the drawings, all the nozzle elements have the same configuration, and each has a pressure chamber and an actuator, such as a PZT piezoelectric element, in addition to the nozzle 12. The pressure chamber is fluidly connected to the nozzle 12 and filled with ink. The actuator is attached to the pressure chamber. When the actuator is applied with a voltage, then the actuator deforms, whereas when the actuator is applied with no voltage, then the actuator maintains its initial shape. The head body 10 is further formed with a manifold and ink inlet ports that introduce ink from the manifold to the corresponding pressure chambers.

Figure 4A:
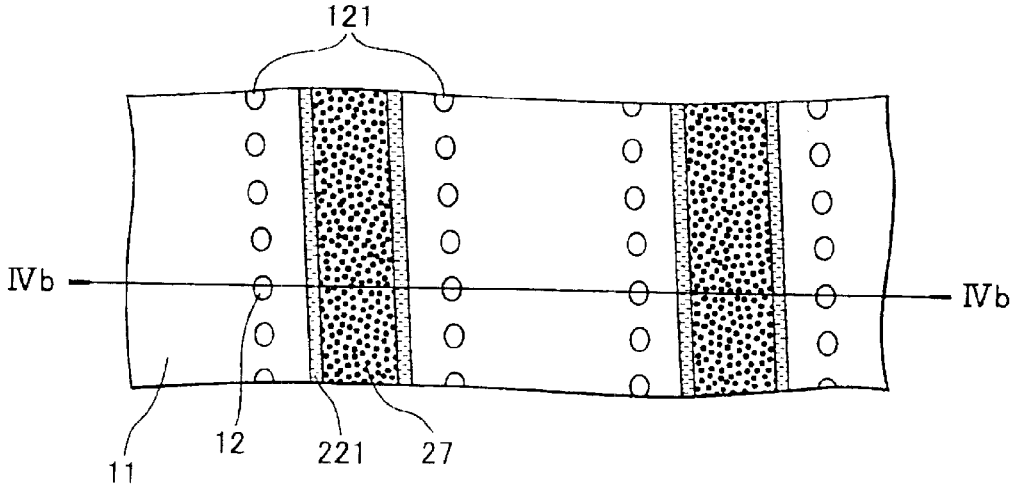
FIG. 4(*a*) is a bottom view of an inkjet head provided with the deflection device of the present invention.
Figure 4B:
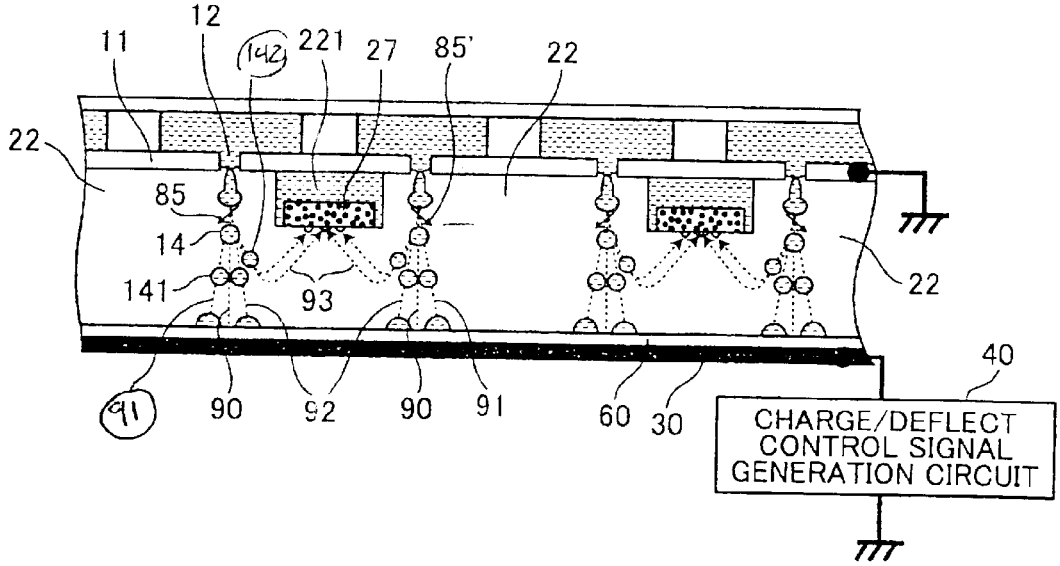

With this configuration, when the ejection signal is applied to the actuator, then the actuator deforms and thus changes the volume of the pressure chamber, whereby as shown in FIG. 4(*b*) ejecting an ink droplet 14 through the corresponding nozzle 12. The ink droplet 14 will be a print ink droplet 141 or a refresh ink droplet 142 depending on the type of ejection signal. That is, the print ink droplet 141 is ejected in response to the recording pulse signal, and the refresh ink droplet 142 is ejected in response to the refresh-ink-ejection pulse signal.

Next, the nozzle electrode array/mounter 20 will be described. As shown in FIG. 3, the nozzle electrode array/mounter 20 includes an electrode plate 21 and a frame 24 to which the electrode plate 21 is adhered. The electrode plate 21 is formed with electrode windows 22 juxtaposed in an array. One electrode window 22 is provided for every two nozzle rows 121 of the head body 10. That is, the electrode windows 22 are provided in one-to-two correspondence with the nozzle rows 121 as shown in FIG. 4(*a*).

The head body 10 is attached to the nozzle electrode array/mounter 20 such that the orifice plate 11 is intimately attached to the electrode plate 21 and that the nozzle rows 121 extends parallel to and between the longitudinal edges of the corresponding electrode windows 22. Precise positional relationships between the nozzle rows 121 and the longitudinal edges of the electrode windows 22 are achieved by matching the pinholes 13, 13' formed in the nozzle plate 11 to the corresponding pinholes 23, 23' formed in the electrode plate 21 when attaching the nozzle plate 11 to the electrode plate 21.

With this configuration, as shown in FIG. 4(*b*), portions of the electrode plate 21 defining the longitudinal edges of the electrode windows 22 serve as nozzle electrodes 221 that extend following the adjacent nozzle rows 121. Ink reception absorption bodies 27 are embedded in the bottom surface of the nozzle electrodes 221. The ink reception absorption bodies 27 are connected to an ink-absorption device (not shown) through a negative pressure pathway 241 and a connection hole 242 formed in the frame 24 shown in FIG. 3.

Because the nozzle electrodes 221 and the orifice plate 11 are both grounded as shown in FIG. 4(*b*), an electric field is generated among the nozzle electrodes 221, the orifice plate 11, and the back electrode 30 to which the charge/deflect voltage is applied from the charge/deflect control signal generation circuit 40. Here, when no electric field is generated among these components, then an ink droplet 14 ejected through the nozzle 12 flies straight along an undeflected flying path 90 without being deflected at all, and impinges on the recording sheet 60.

Figure 5:
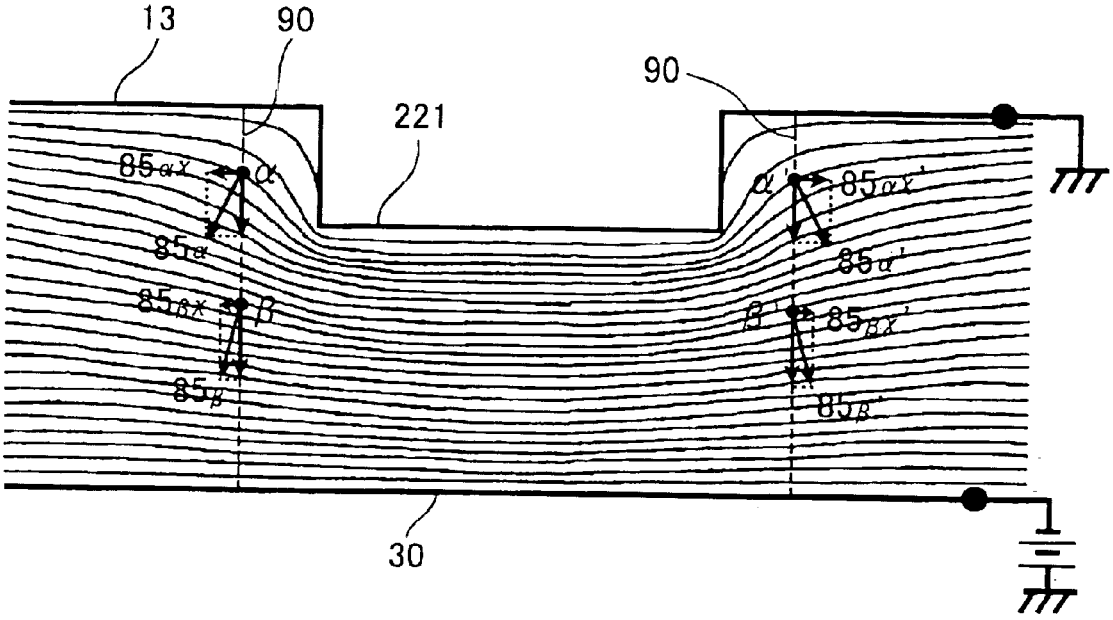
FIG. 5 shows an equipotential surface of an electric field generated by the deflection device.

FIG. 5 shows an equipotential surface of the electric field. As shown in FIGS. 4(*b*) and 5, the electric field generated among the orifice plate 11, the nozzle electrodes 221, and the back electrode 30 is symmetrical about the nozzle electrodes 221. As apparent from FIG. 5, the electric field has a direction that is angled with respect to the sheet surface of the recording sheet 60 at locations α, α around the undeflected flying path 90, thereby providing angled electric fields 85, 85' at both sides of the nozzle electrode 221. Because the angled electric field 85, 85' has a field element 85 α, 85 α' that is perpendicular to an ink ejection direction, a charged ink droplet 14 is deflected by the angled electric field 85, 85'.

More specifically, a positively-charged print ink droplet 141 is deflected to fly along a deflected flying path 91 and impinges on the recording sheet 60. A negatively-charged print ink droplet 141 is deflected to fly along a deflected flying path 92 and impinges on the recording sheet 60. On the other hand, because both a mass and an ejection speed of the refresh ink droplet 142 are set smaller than that of the print ink droplet 141, the refresh ink droplet 142 receives a greater influence from the angled electric field 85 than does the print ink droplet 141, so that a negatively-charged refresh ink droplet 142 is deflected to travel along a U-turn path 93 toward the nozzle electrode 221, and impinges on the ink reception absorption body 27.

It should be noted that the refresh ink droplet 142 is set to be charged negatively, but not positively, so that the refresh ink droplet 142 always flies along the U-turn path 93 to impinge on the ink reception absorption body 27. Also, using the refresh-ink-ejection pulse signal having a greater pulse voltage than the recording pulse signal so as to increase the negative-charge of the refresh ink droplet 142, the refresh ink droplet 142 is further reliably travels along the U-turn path 93. It is even possible to eject the same mass of the refresh ink droplet 142 at the same ejection speed as the print ink droplet 141 to make the refresh ink droplet 142 travel along the U-turn path 93 as long as the refresh ink droplet 142 is charged with sufficient negative charge.

Here, because the angled electric fields 85, 85' have the field elements 85α, 85α' larger than field elements 85β, 85β' of angled electric fields 85β, 85β' at locations β, β', the ink droplets 141, 142 are effectively deflected at early traveling stage.

The refresh ink droplets 142 having impinged on the ink reception absorption bodies 27 are collected into the ink-absorption device (not shown) through the negative pressure pathway 241 and the connection hole 242 by negative pressure. Ejecting the refresh ink droplets 142 during the time period where no dot-recording is preformed by the corresponding nozzles 12 prevents ink clinging around the nozzles 12 from drying and getting condensed. Accordingly, even when it is necessary to eject a print ink droplet 141 from a nozzle 12 which has not ejected a print ink droplet 141 for a while, ink ejection from the nozzle 12 is reliably and stably performed, so that a recording dot 70 can be formed on an exact target location without any displacement.

As described above, according to the present embodiment, one nozzle electrode 221 is provided for every two nozzle electrodes 221 such that ink reception absorption bodies 27 embedded in the nozzle electrodes 221 receive refresh ink droplets 142 ejected from the nozzles 12 of the corresponding two nozzle rows 121 located at both sides. Accordingly, a sufficient space is obtained between a nozzle row 121 and a nozzle electrode 221 that is provided for an adjacent nozzle row 121, enabling generation of the angled electric field 85, 85' capable of deflecting droplets by a sufficient amount. Moreover, because the nozzle electrodes 221 and thus the ink reception absorption bodies 27 can have a sufficient width, the refresh ink droplets 142 can be reliably collected by the ink reception absorption bodies 27 even if the deflected refresh ink droplets 142 travel a relatively longer distance. The refresh ink droplet 142 is reliably prevented from accidentally impinging on the recording sheet 60, whereby high-quality images are reliably provided.

Figure 6:
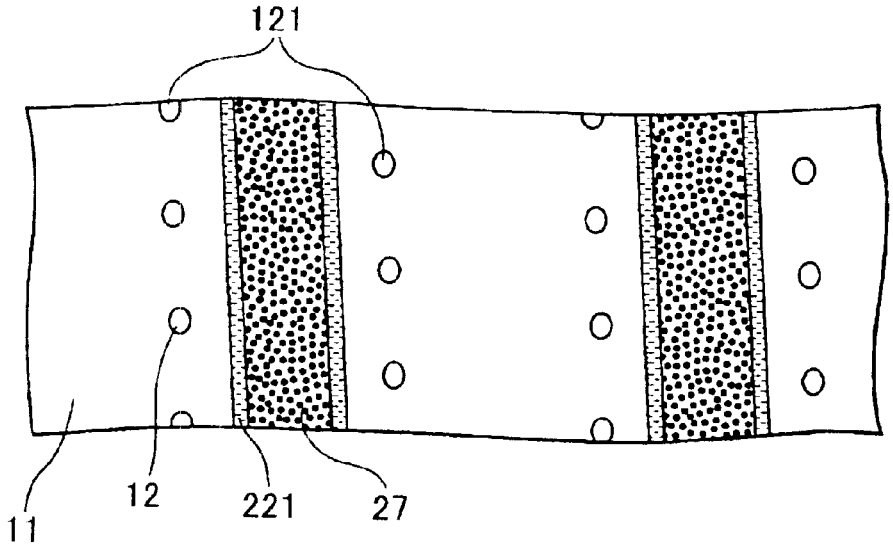
FIG. 6 is a bottom view of an inkjet head according to a modification of the embodiment.

FIGS. 6, shows a modification of the above embodiment, wherein the nozzles 12 are arranged in staggered patterns at both sides of the nozzles rows 121. This configuration also provides the similar effects as in the above embodiment. In addition, refresh ink droplets 142 ejected from nozzle rows 121 at both sides of a nozzle electrode 221 can impinge on a corresponding ink reception absorption body 27 at positions spaced by a predetermined distance with respect to a direction to which each nozzle row 121 extends. Accordingly, the refresh ink droplets 142 are further reliably collected by the ink reception absorption bodies 27.

While some exemplary embodiments of this invention have been described in detail, those skilled in the art will recognize that there are many possible modifications and variations which may be made in these exemplary embodiments while yet retaining many of the novel features and advantages of the invention.

For example, the ink reception absorption bodies 27 are embedded in the nozzle electrodes 221 in the above embodiment. However, the nozzle electrodes 221 could be formed of a porous metal member. In this case, the ink reception absorption bodies 27 could be dispensed with. Moreover, if it is unnecessary to collect refresh ink droplets 142, then the ink reception absorption bodies 27 are unnecessary.

The nozzle electrode array/mounter 20 of the above embodiment is the electrode assembly formed of arrayed nozzle electrodes 221 integrally with each other. However, the nozzle electrode array/mounter 20 could be formed of the nozzle electrodes 221 attached to the orifice plate 11. Alternatively, the orifice plate 11 could be formed to a shape capable of generating the angled electric field 85.

What is claimed is:

1. A combination of an inkjet head and a back electrode, comprising:

an inkjet head including:

a body formed with a plurality of nozzle rows, each including a plurality of nozzles through which ink droplets are ejected; and a plurality of electrodes for generating a deflecting field that deflects the ink droplets ejected from the nozzles, one electrode being provided for every two of the nozzle rows, wherein each electrode is provided between the corresponding adjacent two nozzle rows and is preceded by two adjacent nozzle rows; and a back electrode disposed in confrontation with the body with a recording medium interposed therebetween.

2. The combination according to claim 1, wherein the electrodes receive the ink droplets deflected by the deflecting field, and the deflecting field deflects the ink droplets to make a U-turn during flight such that the deflected ink droplets impinge on the electrodes.

3. The combination according to claim 1, wherein the body includes an orifice plate in which the nozzle rows are formed, and the electrodes are attached to the orifice plate.

4. The combination according to claim 1, wherein the inkjet head further includes an electrode plate integrally formed with the plurality of electrodes, wherein the body includes an orifice plate in which the nozzle rows are formed, and the electrode plate is attached to the orifice plate.

5. The combination according to claim 1, wherein the deflecting field is symmetrical about the electrodes.

6. The combination according to claim 1, wherein the electrodes extend parallel to the nozzle rows.

7. The combination according to claim 6, wherein:

the body includes an orifice plate, in which the nozzle rows are formed, and a plurality of nozzle elements that eject ink droplets through the corresponding nozzles;

the electrodes are attached to the orifice plate, and receive the ink droplets ejected from the nozzles of the corresponding two nozzle rows; and the deflecting field is symmetrical about the electrodes.

8. The combination according to claim 6, wherein the deflecting field deflects the ink droplets to make a U-turn during flight such that the deflected ink droplets impinge on the electrodes.

9. The combination according to claim 1, wherein the electrodes have the same electric potential as ink in the nozzles.

10. An inkjet recording device comprising:

an inkjet head formed with a plurality of nozzle rows, each including a plurality of nozzles through which ink droplets are ejected;

a plurality of electrodes for generating a deflecting field that deflects the ink droplets ejected from the nozzles, one electrode being provided for every two of the nozzle rows; and a back electrode disposed in confrontation with the inkjet head with a recording medium interposed therebetween, wherein each electrode is provided between the corresponding adjacent two nozzle rows and is preceded by two adjacent nozzle rows.

11. The inkjet recording device according to claim 10, wherein the electrodes receive the ink droplets deflected by the deflecting field, and the deflecting field deflects the ink droplets to make a U-turn during flight such that the deflected ink droplets impinge on the electrodes.

12. The inkjet recording device according to claim 11, wherein the electrodes have the same electric potential as ink in the nozzles.

13. The inkjet recording device according to claim 10, wherein the inkjet head includes an orifice plate in which the nozzle rows are formed, and the electrodes are attached to the orifice plate.

14. The inkjet recording device according to claim 10, further comprising an electrode plate integrally formed with the plurality of electrodes, wherein the inkjet head includes an orifice plate in which the nozzle rows are formed, and the electrode plate is attached to the orifice plate.

15. The inkjet head according to claim 10, wherein the deflecting field is symmetrical about the electrodes.

16. The inkjet head according to claim 10, wherein the electrodes extends parallel to the nozzle rows.

17. An inkjet head comprising:

a body formed with a plurality of nozzle rows, each including a plurality of nozzles through which ink droplets are ejected;

a plurality of electrodes for generating a deflecting field that deflects the ink droplets ejected from the nozzles, one electrode being provided for every two of the nozzle rows, wherein each electrode is provided between the corresponding adjacent two nozzle rows; and the deflecting field deflects the ink droplets to make a U-turn during flight such that the deflected ink droplets impinge on the electrodes.

* * * * *